US011519195B2

(12) United States Patent
Van Den Bos

(10) Patent No.: US 11,519,195 B2
(45) Date of Patent: Dec. 6, 2022

(54) FENCING DEVICE FOR INSTALLING AND/OR REMOVING A FENCE

(71) Applicant: Wim Van Den Bos, Amsterdam (NL)

(72) Inventor: Wim Van Den Bos, Amsterdam (NL)

( * ) Notice: Subject to any disclaimer, the term of this patent is extended or adjusted under 35 U.S.C. 154(b) by 119 days.

(21) Appl. No.: 17/042,960

(22) PCT Filed: Mar. 1, 2019

(86) PCT No.: PCT/NL2019/050132
§ 371 (c)(1),
(2) Date: Sep. 29, 2020

(87) PCT Pub. No.: WO2019/190308
PCT Pub. Date: Oct. 3, 2019

(65) Prior Publication Data
US 2021/0017788 A1 Jan. 21, 2021

(30) Foreign Application Priority Data
Mar. 29, 2018 (NL) ..... 2020680

(51) Int. Cl.
*E04H 17/26* (2006.01)
*E04H 17/04* (2006.01)

(52) U.S. Cl.
CPC ..... *E04H 17/263* (2013.01); *E04H 17/04* (2013.01); *E04H 17/265* (2013.01)

(58) Field of Classification Search
CPC ..... E04H 17/263; E04H 17/04; E04H 17/265; E04H 17/261; E02D 7/00; E02D 7/02; E02D 7/04; E02D 7/14; E02D 13/00; E02D 13/04; E02D 13/10; E02D 9/00; E02D 9/02; E02D 11/00; E02D 7/20
See application file for complete search history.

(56) References Cited

U.S. PATENT DOCUMENTS 3,934,655 A * 1/1976 Whistle ..... E04H 17/261 173/28
6,158,923 A * 12/2000 Wheeler ..... E04H 17/261 405/116
9,022,136 B2 * 5/2015 Tate ..... B65H 57/16 173/46

FOREIGN PATENT DOCUMENTS

AU 556755 * 8/1982 ..... E04H 17/22

* cited by examiner

*Primary Examiner* — Lynn E Schwenning
(74) *Attorney, Agent, or Firm* — Patshegen IP; Moshe Pinchas

(57) ABSTRACT

A fencing device 1 comprises installing means for driving the posts 5 of the fence into the ground. These posts are provided with a pointed lower end 9 so that they can easily be driven into the ground. The net with the posts attached thereto is wound on a reel 11. The installing means gradually guide the posts from the reel to the ground, while the lower ends of the posts are driven into the ground. For guiding the posts, the installing means are formed by a guide consisting of a top guide profile 13, two side guide profiles 15 and a bottom guide profile 17. When a temporary fence is erected, the first post is to be driven into the ground manually and supported with a cable or pole. Subsequently, the fence will be unwound from the reel while the trailer is moved on.

4 Claims, 1 Drawing Sheet

FENCING DEVICE FOR INSTALLING AND/OR REMOVING A FENCE

TECHNICAL FIELD OF THE INVENTION

The invention relates to a fencing device for installing and/or removing a fence of posts and a net connected thereto or one or more wires connected thereto, comprising installing means for driving the posts into the ground, as well as a reel for unwinding the net or the one or more wires, which installing means comprise a guide for guiding the posts from the reel to the ground, which guide is inclined obliquely downwards from the reel.

Livestock farmers spend much time on installing a temporary fence to have the meadows grazed and their land used optimally. Also ever more nature reserves are used extensively for cattle. Permanent fences are then not permitted and a temporary fence must therefore be installed.

STATE OF THE ART

A fencing device of this type is known from AU 556755 B. With this known device, the posts are fixed at the lower end to a strip which is installed by guide means in a trench made in the ground.

SUMMARY OF THE INVENTION

It is an object of the invention to provide a fencing device of the type described in the opening paragraph which is simpler than the known device and with which a fence can be installed and removed again more quickly. To this end, the fencing device according to the invention is characterized in that the posts are provided with a pointed lower end and the guide is such that the posts are driven into the ground during the guiding action, and in that the fencing device further includes extraction means for pulling the posts out of the ground, which extraction means are formed by a further guide profile whose top side is in contact with a protrusion on the post during the extraction operation and guides the post upwards while the fencing device is moved on and thus pulls the post out of the ground. When the posts are pulled out and the fence is wound back onto the reel, the fencing device must be present in an inverted position relative to the direction of travel. For this purpose, the fencing device is preferably present on a vehicle or trailer in a rotating manner.

In the fence that is installed with the fencing device according to the invention, the net or the wires are attached to the posts and secured. The first post is to be driven into the ground manually or mechanically and secured with guy wires or struts. Subsequently, when the fencing device is moved on, the fence will unwind from the reel. The distance from the guide to the ground is such that when leaving the guide, the lower end of the posts is in the ground. With the fencing device according to the invention, a fence can be installed and removed again with relatively simple means in a quick and effective manner.

An embodiment of the fencing device according to the invention is characterized in that the guide comprises a top guide profile which is present over the upper end of the post during the installation of the fence and is inclined obliquely downwards from the top of the reel up to a distance above the ground which falls short of the length of the post, the top guide profile guiding the upper end of the post downwards during the installation of the fence until the post is driven into the ground with the lower end. In this embodiment no demands are made of the posts and also the most simple post may be used. The top guide profile has, for example, a U-shaped cross-section and is pointed downwards with the open side, the upper ends of the posts being located in the profile during the installation.

A further embodiment of the fencing device according to the invention is characterized in that the guide comprises two parallel side guide profiles spaced apart from each other between which the posts are guided, wherein during the installation of the fence the bottom of the side guide profiles is in contact with a protrusion or protrusions present on the posts and guides the protrusions downwards while the posts are driven into the ground. In this embodiment, the posts are to be provided with a protrusion to be able to be driven into the ground. This protrusion is, for example, a circular disc provided with a central hole through which the post is projected and which is fixed to the post.

Preferably, the guide further includes a bottom guide profile, whose top is in contact with a protrusion present on the posts during the installation of the fence. This bottom guide profile provides a more stable guidance of the posts and prevents the posts from falling over during operation.

The protrusion for removing the posts out of the ground may be the bottom guide profile. It is alternatively possible to use the bottom guide profile or the side guide profiles for removing the posts by first moving the guide downwards over a distance, so that during the moving on of the device the top of the profile or profiles can engage the protrusion of the posts driven into the ground and can pull them out of the ground in this manner.

BRIEF DESCRIPTION OF THE DRAWINGS

The invention will be further elucidated below on the basis of an example of embodiment of the fencing device according to the present invention represented in the drawings, in which.

DETAILED DESCRIPTION OF THE DRAWINGS

Figure 1:
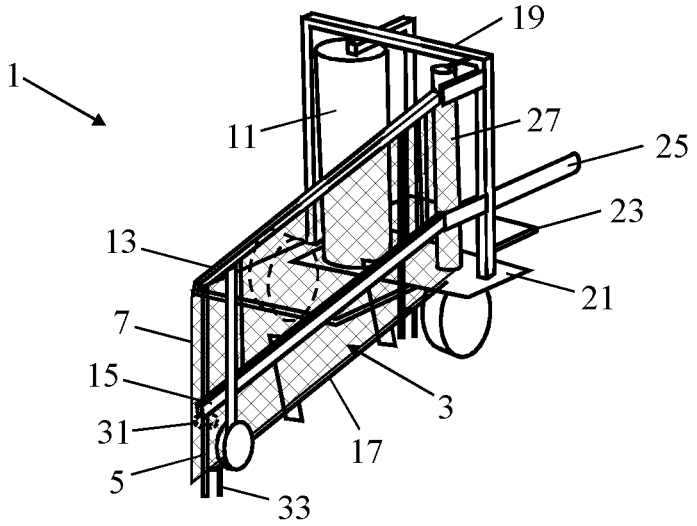
FIG. 1 shows a perspective view of an embodiment of the fencing device.

In the drawing figures is shown in various views an embodiment of the fencing device 1 according to the invention for installing and/or removing a fence 3 of posts 5 and a net 7 connected thereto. The fencing device 1 has installing means for driving the posts 5 of the fence into the ground. These posts are provided with a pointed lower end 9 so that they can easily be driven into the ground. The net with the posts attached thereto is wound on a reel 11. The installing means gradually guide the posts from the reel to the ground, the lower ends of the posts being driven into the ground. The installing means are formed by a guide for guiding the posts and consist of a top guide profile 13, two side guide profiles 15 and a bottom guide profile 17. When installing a temporary fence, the first post is to be driven into the ground manually and supported with a cable 18 or pole. Subsequently, the fence will be unwound from the reel while the trailer is moved on.

The guide profiles are attached with one end to a frame 19 which is present on a rotating platform 21. This platform is pivotally arranged on a trailer 23, which is provided with a drawbar 25 for coupling behind a tow vehicle. The reel 11 is also present on the platform, as is a guide roller 27, which guides the fence 3 to be installed from the reel 11 to the guide. The guide profiles guide the posts 5 from the guide roller 27 to the ground 29 and are inclined obliquely downwards from the guide roller. During the installation of the fence, the top guide profile 13 is present over the top of the posts 5 and is inclined obliquely downwards from the top of the guide roller 27 up to a distance above the ground 29 which distance falls short of the length of the posts.

The top guide profile is formed by a U-shaped profile whose open side points downwards. While being guided, the top of the posts is accommodated in the U-shaped profile. During the installation of the fence, this top guide profile 13 guides the tops of the posts 5 downwards until the posts are driven into the ground 29 with the lower end 9. Instead of this or in addition, the posts may also be driven into the ground by the side guide profiles 15 between which the posts are guided. In that case, the posts 5 must be provided with protrusions 31 which are in contact with the bottom of the side guide profiles. In this embodiment these protrusions are formed by discs attached to the posts.

The guide further includes a bottom guide profile 17, the top of which is in contact with a further protrusion 33 on the posts 5 during the installation of the fence. This protrusion forms a curved pin which is also driven into the ground, so that the post is more stable in the ground. This bottom guide profile prevents the posts from falling over. This bottom guide profile is designed as a rod, but could also be a U-shaped profile that supports and guides the lower end of the posts.

Figure 2:
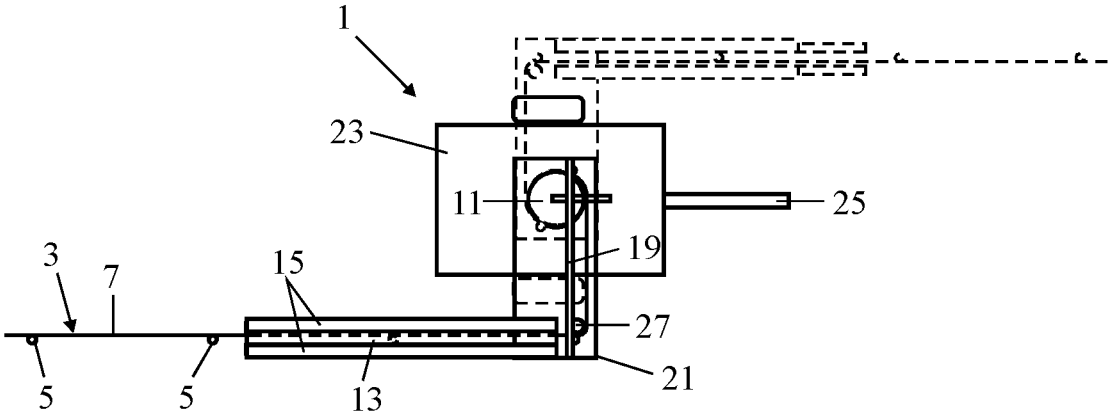
FIG. 2 shows a top view of the fencing device.
Figure 3:
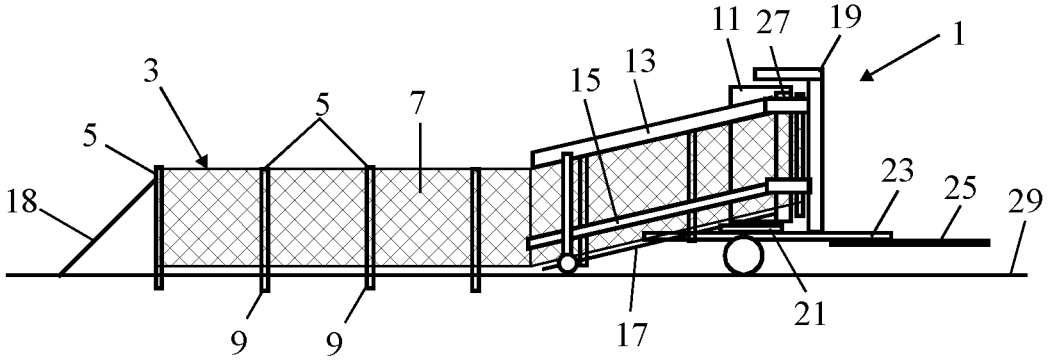
FIG. 3 shows a side view of the fencing device.

The fencing device may also be used for pulling the posts out of the ground again and rewinding the fence on the reel. For this purpose, the platform with the reel and the inverted roller on top and the guide attached thereto must be rotated through 180 degrees, which is indicated by broken lines in FIG. 2. For pulling the posts out of the ground, the posts must be provided with an extra protrusion, for example a protrusion similar to the protrusion 31. For pulling the posts out of the ground, the fencing device may be provided with a further guide profile whose top side is in contact with the protrusions on the post. When the fencing device is moved on, the posts are guided upwards and thereby pulled out of the ground. Instead of an additional guide profile, also the already existing side guide profiles 15 may be used to pull the posts out of the ground. The top of the side guide profiles comes into contact with the extra protrusion on the post and guides this upwards, pulling the post out of the ground. Instead of an extra protrusion, the protrusion 31 may also be used to pull out the post. In that case the side guide profiles should be slightly lowered, so that the top of the free end can engage the bottom of the protrusion.

Although the present invention is elucidated above on the basis of the drawings, it should be noted that this invention is not limited whatsoever to the embodiment shown in the drawings. The invention also extends to any embodiments deviating from the embodiment shown in the drawings within the scope of the invention defined by the appended claims.

The invention claimed is:

1. Fencing device for installing and/or removing a fence (3) of posts (5) and a net (7) connected thereto or one or more wires connected thereto, the fencing device being a movable fencing device that during operation is present on a vehicle or trailer, the fencing device comprising:

a reel (11) for unwinding the net or the one or more wires;

a guide (13, 15, 17) having at least one guide profile for guiding the posts (5) from the reel (11) to the ground (29), and for extraction of the posts from the ground, said guide is inclined obliquely downwards from the reel (11), wherein said guide is configured such that a bottom portion of said at least one guide profile engages a first protrusion on the posts such that the posts are driven into the ground during the guiding action and wherein said guide is further configured such that a top portion of said at least one guide profile engages a second protrusion on the posts during the extraction operation and guides the post upwards while the fencing device is moved on and thus pulls the post out of the ground.

2. Fencing device as claimed in claim 1, wherein the at least one guide profile comprises a top guide profile (13) which is present over the upper end of the post (5) during installation of the fence and is inclined obliquely downwards from the top of the reel up to a distance above the ground which falls short of the length of the post, with the top guide profile guiding the upper end of the post downwards during he installation of the fence until the post is driven into the ground with the lower end.

3. Fencing device as claimed in claim 1, wherein the at least one guide profile comprises two parallel side guide profiles (15) spaced apart from each other between which the posts (5) are guided, wherein during the installation of the fence (3) the bottom of the side guide profiles is in contact with a protrusion (31) or protrusions present on the posts and guides the protrusions downwards while the posts are driven into the ground.

4. Fencing device as claimed in claim 1, wherein the at least one guide profile comprises a bottom guide profile (17) whose top is in contact with a protrusion (23) present on the posts (5) during the installation of the fence.

* * * * *